US009770096B1

(12) United States Patent
Meyer

(10) Patent No.: US 9,770,096 B1
(45) Date of Patent: Sep. 26, 2017

(54) PORTABLE TABLE

(71) Applicant: Jeremy Matthew Meyer, Seattle, WA (US)

(72) Inventor: Jeremy Matthew Meyer, Seattle, WA (US)

( * ) Notice: Subject to any disclaimer, the term of this patent is extended or adjusted under 35 U.S.C. 154(b) by 0 days.

(21) Appl. No.: 15/292,000

(22) Filed: Oct. 12, 2016

Related U.S. Application Data

(60) Provisional application No. 62/242,937, filed on Oct. 16, 2015.

(51) Int. Cl.

| | |
|---|---|
| ***A47B 3/00*** | (2006.01) |
| ***A47B 3/10*** | (2006.01) |
| ***A47B 3/06*** | (2006.01) |
| ***A47B 9/20*** | (2006.01) |
| ***A47B 9/08*** | (2006.01) |
| ***A47B 13/08*** | (2006.01) |
| ***A47B 96/02*** | (2006.01) |
| ***A47B 96/06*** | (2006.01) |
| ***A45C 9/00*** | (2006.01) |

(52) U.S. Cl.
CPC ..... *A47B 3/10* (2013.01); *A45C 9/00* (2013.01); *A47B 3/06* (2013.01); *A47B 9/08* (2013.01); *A47B 9/20* (2013.01); *A47B 13/088* (2013.01); *A47B 96/02* (2013.01); *A47B 96/06* (2013.01); *A47B 2003/008* (2013.01); *A47B 2200/0054* (2013.01); *A47B 2200/0086* (2013.01)

(58) Field of Classification Search
CPC ..... A47B 3/10; A47B 5/00; A47B 83/045
USPC ..... 108/34, 35, 33, 38, 43, 49, 95, 96, 94, 108/90; 297/175, 17
See application file for complete search history.

(56) References Cited

U.S. PATENT DOCUMENTS

| | | | | | |
|---|---|---|---|---|---|
| 1,060,295 | A | * | 4/1913 | Stiles | A47B 41/02 108/32 |
| 1,072,060 | A | * | 9/1913 | Thompson | A47B 13/023 108/150 |
| 1,533,494 | A | * | 4/1925 | Billburg | A45C 9/00 108/34 |
| 2,862,777 | A | * | 12/1958 | Paige | A47B 3/083 108/34 |
| 3,909,061 | A | * | 9/1975 | Johnson | A47C 4/52 297/17 |
| 4,011,821 | A | * | 3/1977 | Neal | A47B 3/12 108/156 |
| 4,123,977 | A | * | 11/1978 | Heath | A45F 3/00 108/25 |
| 4,445,731 | A | * | 5/1984 | Ahmann | A47B 43/00 235/50 B |

(Continued)

*Primary Examiner* — Jose V Chen
(74) *Attorney, Agent, or Firm* — Plager Schack LLP

(57) ABSTRACT

A portable table includes a table top that can be transformed into a carrying case, with a handle and a lock and can be used as a table by releasing a pair of lock clips and opening the table at its hinges. The carrying case can hold four telescopic legs, in storing slots, and a shelf on other side of the hinges. The telescopic legs can be used in a table by attaching leg nubs to slots for legs underneath the table top. Each telescopic leg nests two extendible leg pieces, held by a top and a bottom leg clamps, for height adjustment. The leg also has a leg cap at the end for providing non-slip surface. A shelf can be strapped to the telescopic legs for storing accessories by opening the two hexagonal pieces of the shelf and attaching the hooks above the top clamp.

5 Claims, 4 Drawing Sheets

(56) References Cited

U.S. PATENT DOCUMENTS

| | | | | | |
|---|---|---|---|---|---|
| 4,523,526 | A * | 6/1985 | O'Neill | A47B 43/006 | 108/149 |
| 4,660,904 | A * | 4/1987 | Stephens | A47B 19/08 | 108/34 |
| 4,887,536 | A * | 12/1989 | Teichner | A47B 3/10 | 108/35 |
| 5,060,580 | A * | 10/1991 | Shaw | A47B 3/06 | 108/25 |
| 5,438,938 | A * | 8/1995 | Meeker | A47B 23/001 | 108/127 |
| 5,660,117 | A * | 8/1997 | Noble | A47B 23/043 | 108/35 |
| 6,467,843 | B1 * | 10/2002 | Rossborough | A47C 3/34 | 108/150 |
| 6,905,166 | B2 * | 6/2005 | Zhurong | A47B 3/0912 | 108/132 |
| 6,969,112 | B1 * | 11/2005 | Sherrill | A47C 4/20 | 297/16.1 |
| 8,181,285 | B1 * | 5/2012 | Jackson | A47K 3/122 | 297/16.1 |

* cited by examiner

PORTABLE TABLE

RELATED APPLICATION

This application claims priority to provisional patent application U.S. Ser. No. 62/242,937 filed on Oct. 16, 2015, the entire contents of which is herein incorporated by reference.

BACKGROUND

The embodiments herein relate generally to a portable table with adjustable legs and a shelf that can be carried in a carrying bag.

Prior to embodiments of the disclosed invention the portable tables did not have adjustable legs, especially useful for leveling in an outdoor setting. Further, the tables did not have a shelf for storing accessories. Embodiments of the disclosed invention solve this problem.

SUMMARY

A portable table includes a table top that can be transformed into a carrying case, with a handle and a lock and can be used as a table by releasing a pair of lock clips and opening the table at its hinges. The carrying case can hold four telescopic legs, in storing slots, and a shelf on other side of the hinges. The telescopic legs can be used in a table by attaching leg nubs to slots for legs underneath the table top. Each telescopic leg nests two extendible leg pieces, held by a top and a bottom leg clamps, for leveling the table to ground. The leg also has a leg cap at the end for providing non-slip surface. A shelf can be strapped to the telescopic legs for storing accessories by opening the two hexagonal pieces of the shelf and attaching the hooks above the top clamp.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
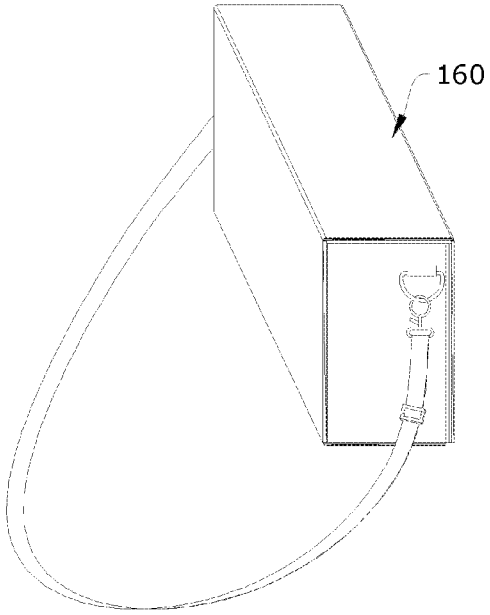
FIG. 1 shows a schematic of perspective view of one embodiment of the present invention.

Turning to FIGS. 1-14, portable table 10 comprises table top 12. Table top 12 further comprises first clamshell 14 connected to second clamshell 16 with first hinge 18 and second hinge 20. First clamshell 14 is attached to first clamshell third leg attachment point 22, first clamshell fourth leg attachment point 24, first hinge lock 26, second hinge lock 28, first handle 30, first locking latch 32, first shelf alignment bar 34 and second shelf alignment bar 36. In an open mode of operation first hinge 18 is locked into an open position by putting first hinge lock 26 over first hinge 18 and locking first hinge 18 into the open position. Similarly, second hinge 20 is locked into an open position by putting second hinge lock 28 over second hinge 20 and locking second hinge 20 into the open position.

Shelf 38 can fit between first shelf alignment bar 34, second shelf alignment bar 36, first hinge lock 26, second hinge lock 28 and first locking latch 32 is a closed mode of operation. Shelf 38 further comprises shelf first section 40 connected to shelf second section 42 with first shelf hinge 44 and second shelf hinge 46. Shelf first section 40 further comprises first section first flat edge corner 48, first section second flat edge corner 50, first hook first holder 52, first hook second holder 54, second hook first holder 56, and second hook second holder 58. Shelf second section 42 further comprises second section first flat edge corner 60, second section second flat edge corner 62, third hook first holder 64, third hook second holder 66, fourth hook first holder 68, and fourth hook second holder 70.

First strap 72 is attached to first hook 74 and fourth hook 76. First strap 72 is attached to first section second flat edge corner 50 with first strap first connector 78. First strap 72 is attached to second section first flat edge corner 60 with first strap second connector 80.

Second strap 82 is attached to second hook 84 and third hook 86. Second strap 82 is attached to first section first flat edge corner 48 with second strap first connector 88. Second strap 82 is attached to second section second flat edge corner 62 with second strap second connector 90.

Second clamshell 16 is attached to second clamshell first leg attachment point 92, second clamshell second leg attachment point 94, first leg bracket 96, second leg bracket 98, second handle 100 and latch receiver 102. First leg 104, second leg 106, third leg 108 and fourth leg 110 can be held in place with first leg bracket 96 and second leg bracket 98.

First leg 104 further comprises first leg first telescopic leg portion 112 connected to first leg second telescopic leg portion 114 with first leg first telescopic lock 116. First leg second telescopic leg portion 114 is connected to first leg third telescopic leg portion 118 with first leg second telescopic lock 120.

Second leg 106 further comprises second leg first telescopic leg portion 122 connected to second leg second telescopic leg portion 124 with second leg first telescopic lock 126. Second leg second telescopic leg portion 124 is connected to second leg third telescopic leg portion 128 with second leg second telescopic lock 130.

Third leg 108 further comprises third leg first telescopic leg portion 132 connected to third leg second telescopic leg portion 134 with third leg first telescopic lock 136. Third leg second telescopic leg portion 134 is connected to third leg third telescopic leg portion 138 with third leg second telescopic lock 140.

Fourth leg 110 further comprises fourth leg first telescopic leg portion 142 connected to fourth leg second telescopic leg portion 144 with fourth leg first telescopic lock 146. Fourth leg second telescopic leg portion 144 is connected to fourth leg third telescopic leg portion 148 with fourth leg second telescopic lock 150.

First leg 104 is attached to second clamshell first leg attachment point 92 with first leg attachment portion 152. Second leg 106 is attached to second clamshell second leg attachment point 94 with second leg attachment portion 154. Third leg 108 is attached to first clamshell third leg attachment point 22 with third leg attachment portion 156. Fourth leg 110 is attached to first clamshell fourth leg attachment point 24 with fourth leg attachment portion 158.

Figure 2:
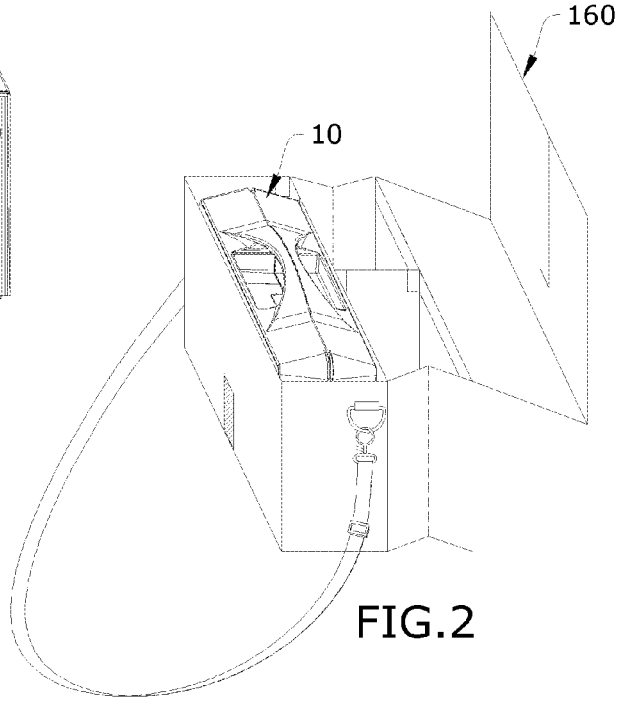
FIG. 2 shows a schematic of perspective view of one embodiment of the present invention.
Figure 3:
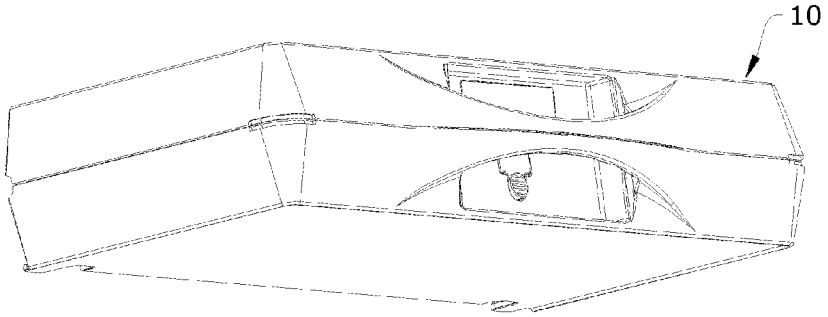
FIG. 3 shows a schematic of perspective view of one embodiment of the present invention.
Figure 4:
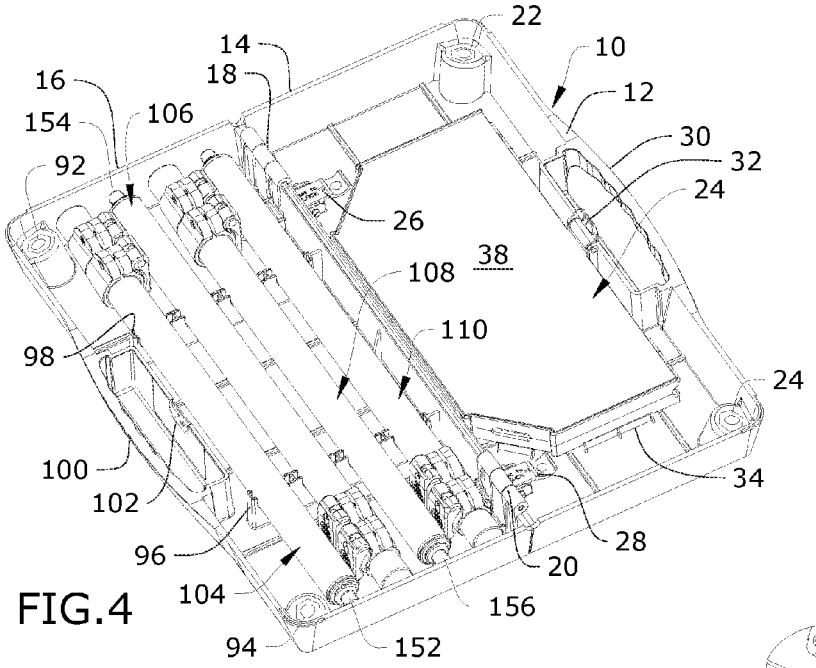
FIG. 4 shows a schematic of perspective view of one embodiment of the present invention.
Figure 6:
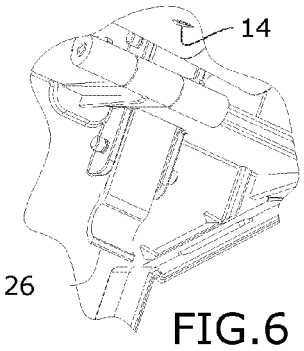
FIG. 6 shows a schematic of perspective view of one embodiment of the present invention.
Figure 5:
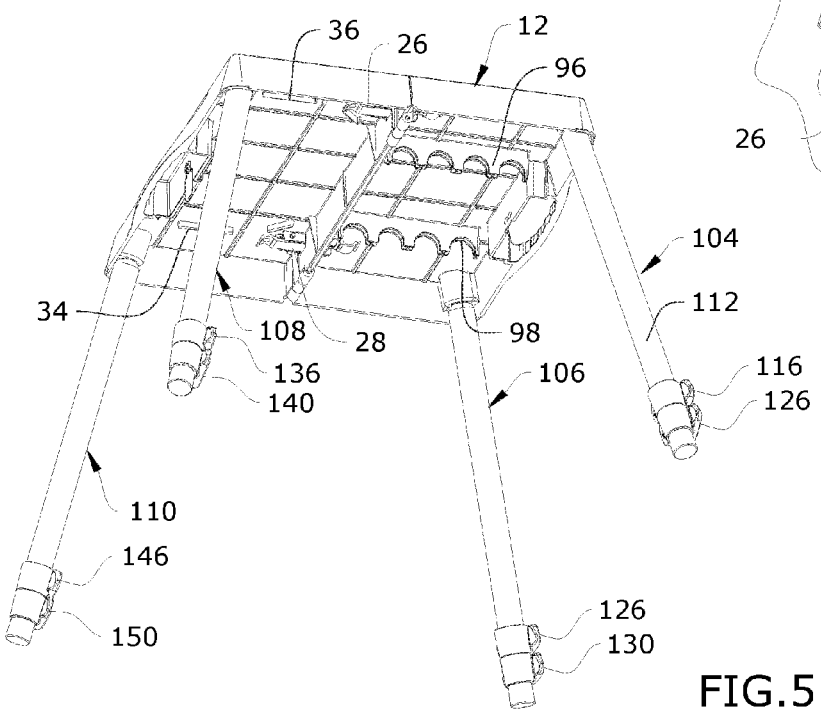
FIG. 5 shows a schematic of perspective view of one embodiment of the present invention.
Figure 7:
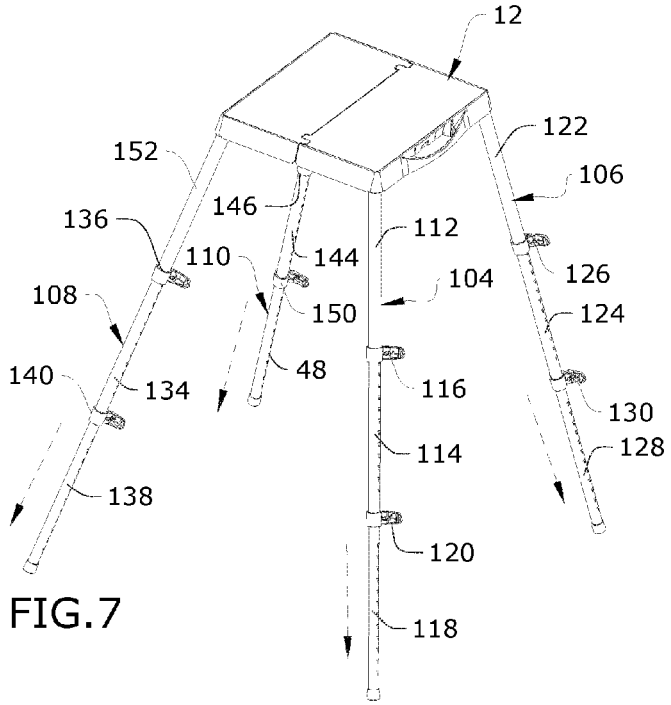
FIG. 7 shows a schematic of perspective view of one embodiment of the present invention.
Figure 8:
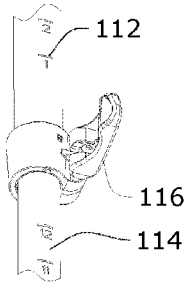
FIG. 8 shows a schematic of perspective view of one embodiment of the present invention.
Figure 9:
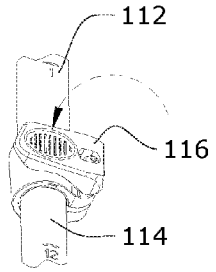
FIG. 9 shows a schematic of perspective view of one embodiment of the present invention.
Figure 10:
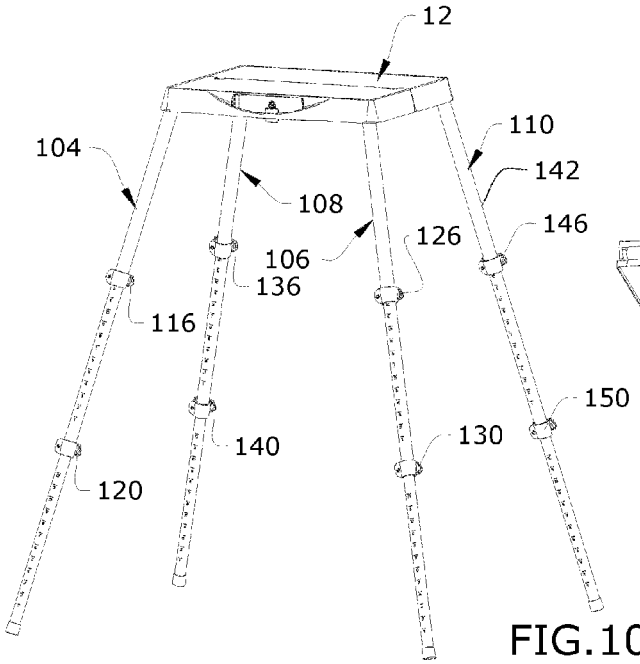
FIG. 10 shows a schematic of perspective view of one embodiment of the present invention.
Figure 11:
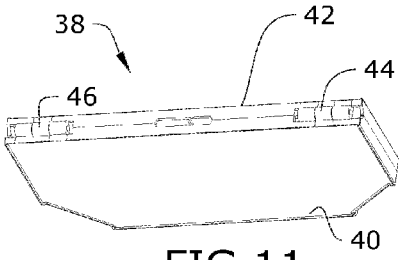
FIG. 11 shows a schematic of perspective view of one embodiment of the present invention.
Figure 12:
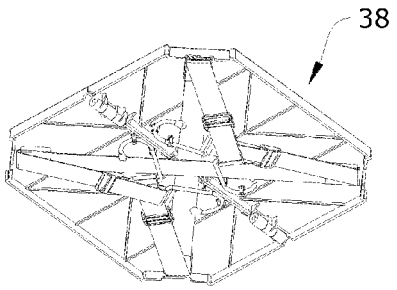
FIG. 12 shows a schematic of perspective view of one embodiment of the present invention.
Figure 13:
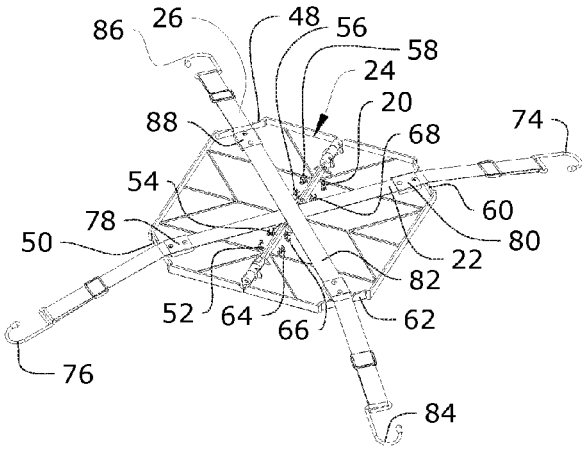
FIG. 13 shows a schematic of perspective view of one embodiment of the present invention.
Figure 14:
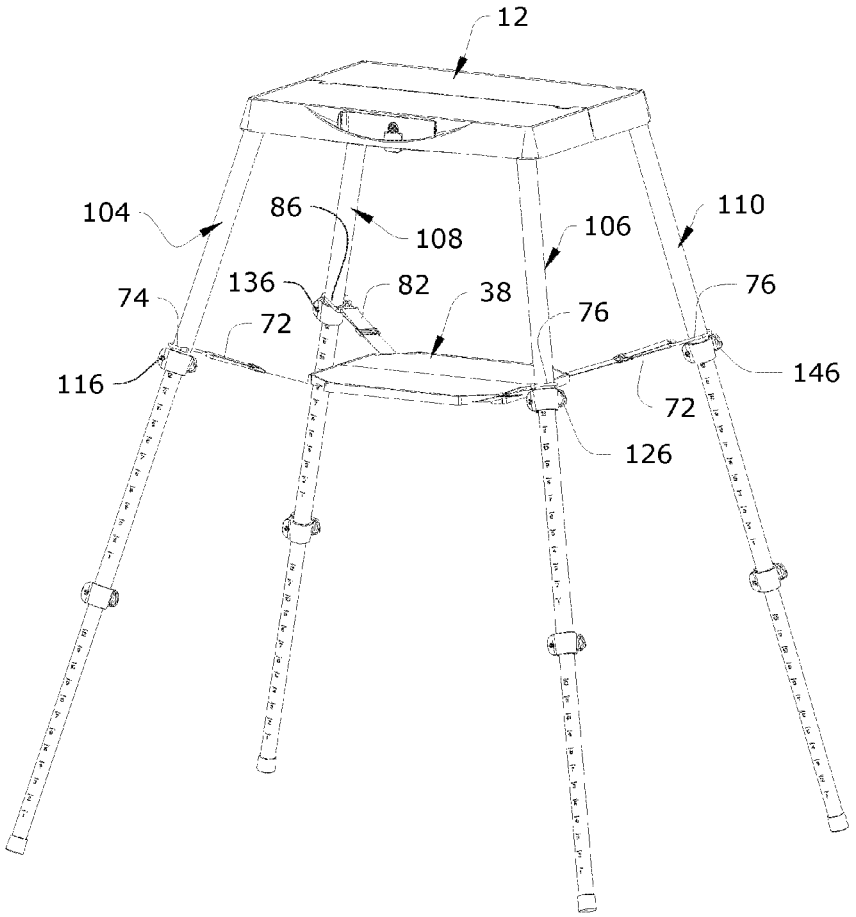
FIG. 14 shows a schematic of perspective view of one embodiment of the present invention.

When arranged in a closed mode of operation as shown in FIG. 3, portable table 10 can be inserted into travel bag 160 as shown in FIG. 1 and FIG. 2. The parts of the table are made by using injection molds and standard metal tools.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶6. In particular, any use of "step of" in the claims is not intended to invoke the provision of 35 U.S.C. §112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A portable table, further comprising:

a table top having a first clamshell rotatably connected to a second clamshell; wherein the first clamshell is attached to the second clamshell with a first hinge and a second hinge; the table top further comprising:

a first hinge lock, mechanically coupled to the first clamshell proximate the first hinge;

a second hinge lock, mechanically coupled to the first clamshell proximate the second hinge;

a first handle, mechanically coupled to the first clamshell, distant the first hinge and the second hinge;

a first locking latch, mechanically coupled to the first clamshell proximate the first handle;

a first shelf alignment bar, mechanically coupled to the first clamshell between the first hinge lock and the first locking latch;

a second shelf alignment bar, mechanically coupled to the first clamshell between the second hinge lock and the first locking latch;

a first leg, attached to the second clamshell at a second clamshell first leg attachment point; wherein the first leg further comprises a first leg first telescopic leg portion connected to a first leg second telescopic leg portion with a first leg first telescopic lock; the first leg second telescopic leg portion is connected to a first leg third telescopic leg portion with a first leg second telescopic lock;

a second leg, attached to the second clamshell at a second clamshell second leg attachment point; wherein the second leg further comprises a second leg first telescopic leg portion connected to a second leg second telescopic leg portion with a second leg first telescopic lock; the second leg second telescopic leg portion is connected to a second leg third telescopic leg portion with a second leg second telescopic lock;

a third leg, attached to the first clamshell at a first clamshell third leg attachment point; wherein the third leg further comprises a third leg first telescopic leg portion connected to a third leg second telescopic leg portion with a third leg first telescopic lock; the third leg second telescopic leg portion is connected to a third leg third telescopic leg portion with a third leg second telescopic lock; and a fourth leg, attached to the first clamshell at a first clamshell fourth leg attachment point; wherein the fourth leg further comprises a fourth leg first telescopic leg portion connected to a fourth leg second telescopic leg portion with a fourth leg first telescopic lock; the fourth leg second telescopic leg portion is connected to a fourth leg third telescopic leg portion with a fourth leg second telescopic lock.

2. The portable table of claim 1, wherein an open mode of operation the first hinge is locked into an open position by putting the first hinge lock over the first hinge and locking the first hinge into the open position while the second hinge is locked into the open position by putting the second hinge lock over the second hinge and locking the second hinge into the open position.

3. The portable table of claim 1, further comprising a shelf, fit between the first shelf alignment bar, the second shelf alignment bar, the first hinge lock, the second hinge lock and the first locking latch in a closed mode of operation.

4. The portable table of claim 3, wherein the shelf further comprises a shelf first section connected to a shelf second section with a first shelf hinge and a second shelf hinge;

wherein the shelf first section further comprises a first section first flat edge corner, a first section second flat edge corner, a first hook first holder, a first hook second holder, a second hook first holder, and a second hook second holder; and wherein the shelf second section further comprises a second section first flat edge corner, a second section second flat edge corner, a third hook first holder, a third hook second holder, a fourth hook first holder, and a fourth hook second holder.

5. The portable table of claim 4, further comprising:

a first strap, attached to a first hook and a fourth hook; wherein the first strap is attached to the first section second flat edge corner with a first strap first connector; wherein the first strap is attached to the second section first flat edge corner with a first strap second connector; and a second strap, attached to a second hook and a third hook; wherein the second strap is attached to the first section first flat edge corner with a second strap first connector; the second strap is attached to the second section second flat edge corner with a second strap second connector.

* * * * *